US010536766B1

(12) United States Patent
Singer

(10) Patent No.: US 10,536,766 B1
(45) Date of Patent: Jan. 14, 2020

(54) EARPHONE CORD ORGANIZER

(71) Applicant: Susan Singer, Rochester, NY (US)

(72) Inventor: Susan Singer, Rochester, NY (US)

( * ) Notice: Subject to any disclaimer, the term of this patent is extended or adjusted under 35 U.S.C. 154(b) by 0 days.

(21) Appl. No.: 16/037,112

(22) Filed: Jul. 17, 2018

(51) Int. Cl.
*H04R 1/10* (2006.01)

(52) U.S. Cl.
CPC ..... *H04R 1/1033* (2013.01); *H04R 1/1066* (2013.01); *B65H 2701/3919* (2013.01); *H04R 2420/09* (2013.01); *H04R 2499/11* (2013.01)

(58) Field of Classification Search
CPC ..... H04R 1/1033; H04R 1/1066; H04R 2420/09; H04R 2499/11; B65H 2701/3919; H65H 75/06; H65H 75/446
USPC ..... 381/384; 242/118
See application file for complete search history.

(56) References Cited

U.S. PATENT DOCUMENTS

| | | | | |
|---|---|---|---|---|
| 6,698,560 | B2 | 3/2004 | Reardon | |
| 6,942,173 | B1 | 9/2005 | Abramov | |
| 7,108,544 | B2 | 9/2006 | Zoller | |
| D620,781 | S | 8/2010 | Weckworth | |
| 8,523,098 | B2 * | 9/2013 | Detweiler | B65H 75/28 242/400.1 |
| 10,285,479 | B1 * | 5/2019 | Bradberry | G06F 1/1628 |
| 10,369,484 | B2 * | 8/2019 | Barnas | H02G 11/02 |
| 2007/0154048 | A1 | 7/2007 | Chang | |
| 2009/0036175 | A1 | 2/2009 | Brandenburg | |
| 2013/0126661 | A1 * | 5/2013 | Detweiler | B65H 75/28 242/550 |
| 2013/0168478 | A1 * | 7/2013 | Holman | B65H 75/06 242/118 |
| 2016/0010672 | A1 * | 1/2016 | Long | H04R 1/1033 24/122.3 |
| 2016/0050481 | A1 * | 2/2016 | Moats | H04R 1/1033 381/384 |
| 2017/0018914 | A1 * | 1/2017 | Barnas | H02G 11/02 |

FOREIGN PATENT DOCUMENTS

| | | |
|---|---|---|
| WO | 2012022961 | 2/2012 |

* cited by examiner

*Primary Examiner* — Binh Kien Tieu

(57) ABSTRACT

The earphone cord organizer is an accessory for a phone that couples to the phone and provides storage for a pair of earphones or earbuds. The earphone cord organizer attaches to an existing phone connector via a male electrical connector that is part of the coupler body. A female electrical connector on the coupler body may be wired to the male electrical connector and allow an external cable to connect to the phone even with the organizer in place. The organizer also comprises two arms to retain the cord. Earphones may be stored on the organizer by wrapping the cord of the earphones around the coupler body. A pair of wrap extenders protruding from the arms towards the phone may increase the size of the core of the organizer to better accommodate the cord.

17 Claims, 7 Drawing Sheets

EARPHONE CORD ORGANIZER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal electronics, more specifically, an earphone cord organizer.

SUMMARY OF INVENTION

The earphone cord organizer is an accessory for a phone that couples to the phone and provides storage for a pair of earphones or earbuds. The earphone cord organizer attaches to an existing phone connector via a male electrical connector that is part of the coupler body. A female electrical connector on the coupler body may be wired to the male electrical connector and allow an external cable to connect to the phone even with the organizer in place. The organizer also comprises two arms to retain the cord. Earphones may be stored on the organizer by wrapping the cord of the earphones around the coupler body. A pair of wrap extenders protruding from the arms towards the phone may increase the size of the core of the organizer to better accommodate the cord.

An object of the invention is to provide an accessory for storing earphones on a phone.

Another object of the invention is to couple the earphone cord organizer to the phone via an electrical connector on the phone.

A further object of the invention is to provide an electrical connector on the organizer that is electrically and mechanically equivalent to the connector on the phone to make the phone connector accessible for use.

Yet another object of the invention is to provide arms and wrap extenders to better manage the storage of the earphone cord.

These together with additional objects, features and advantages of the earphone cord organizer will be readily apparent to those of ordinary skill in the art upon reading the following detailed description of the presently preferred, but nonetheless illustrative, embodiments when taken in conjunction with the accompanying drawings.

In this respect, before explaining the current embodiments of the earphone cord organizer in detail, it is to be understood that the earphone cord organizer is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the earphone cord organizer.

It is therefore important that the claims be regarded as including such equivalent construction insofar as they do not depart from the spirit and scope of the earphone cord organizer.

It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
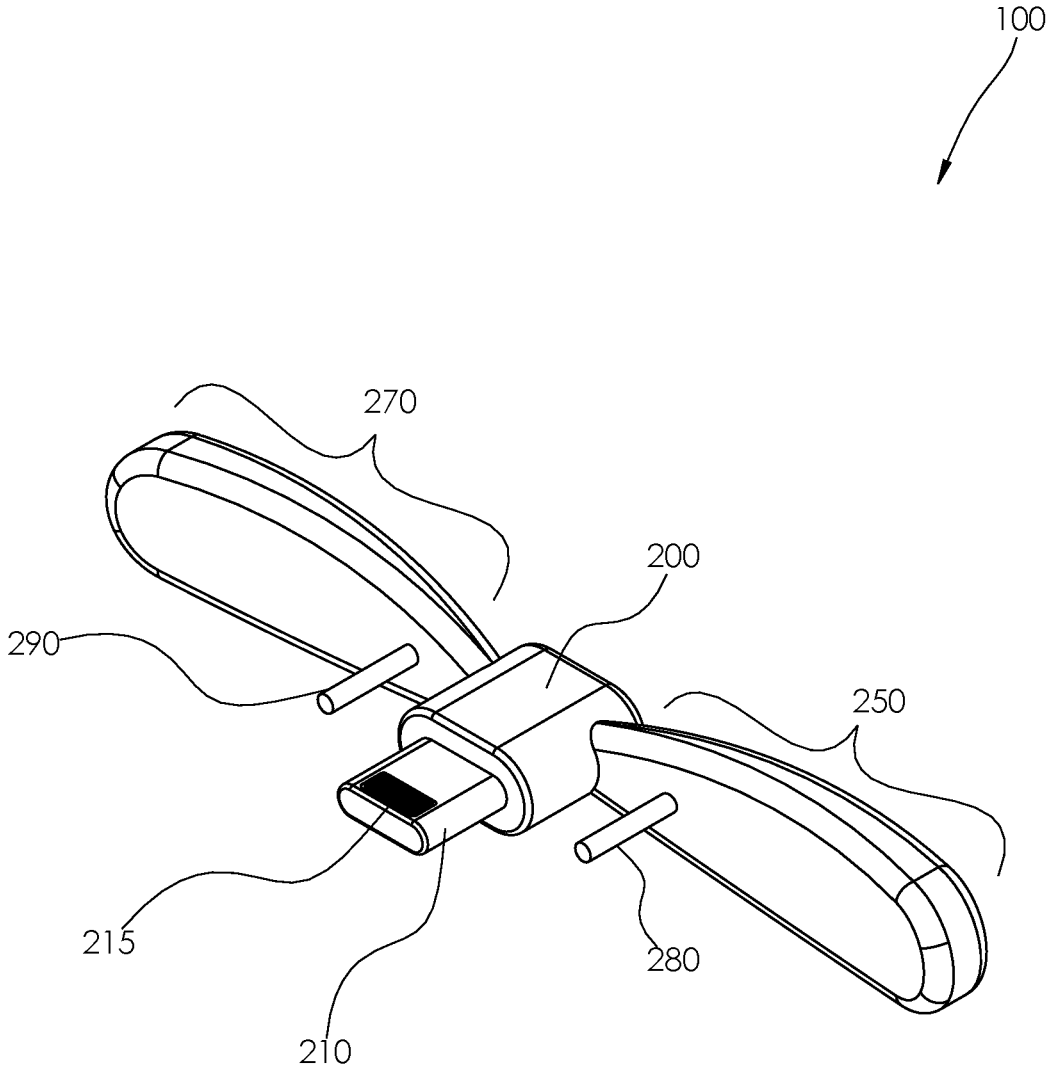
FIG. 1 is a perspective view of an embodiment of the disclosure.
Figure 2:
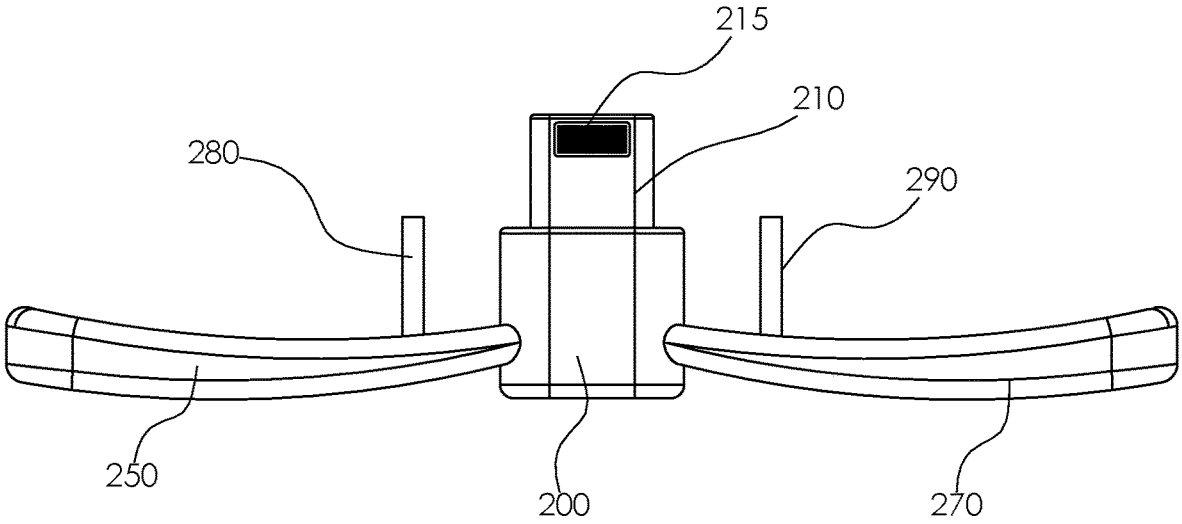
FIG. 2 is a top view of an embodiment of the disclosure.
Figure 3:
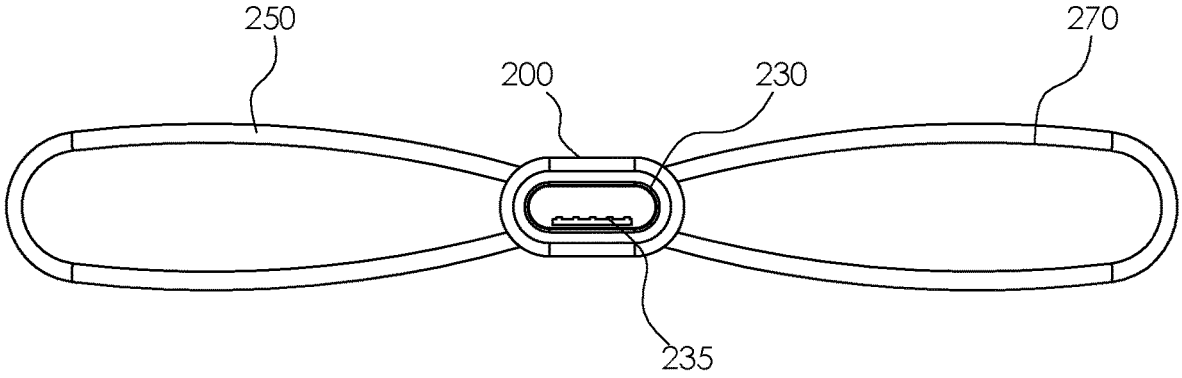
FIG. 3 is a front view of an embodiment of the disclosure.
Figure 4:
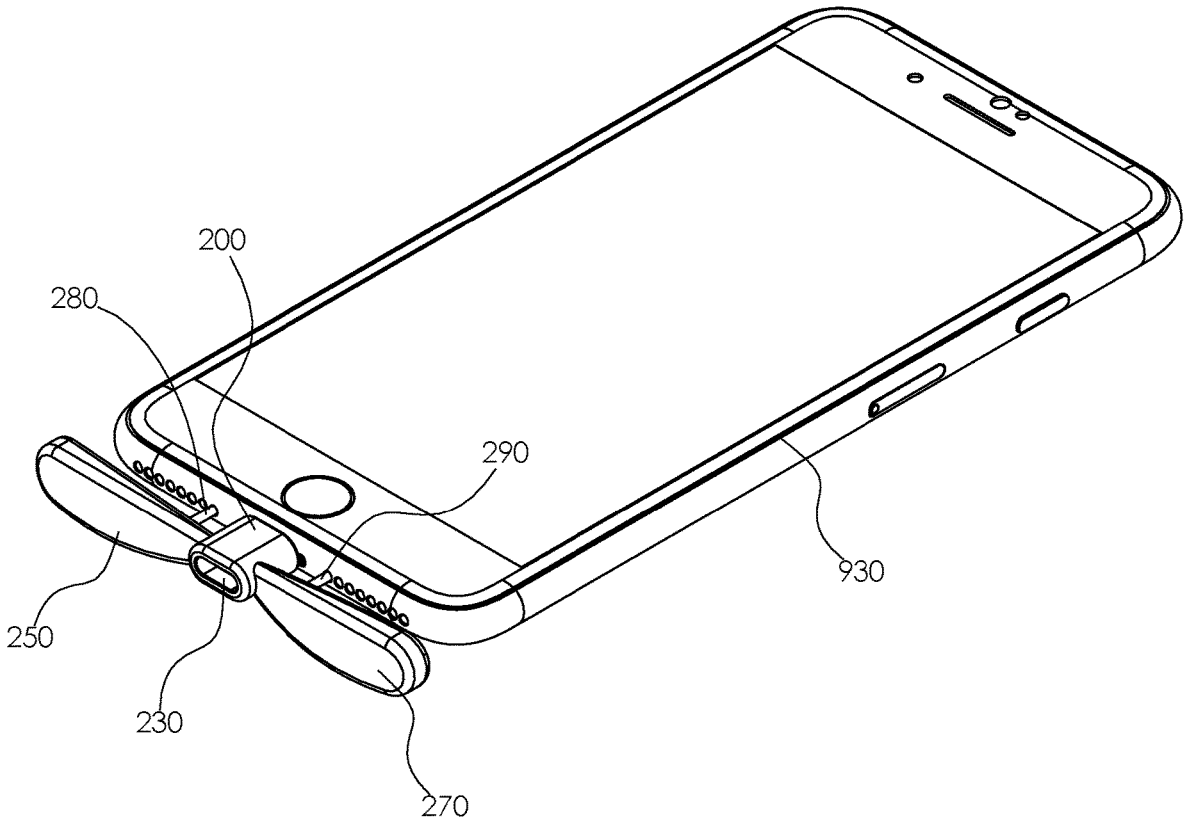
FIG. 4 is a perspective view of an embodiment of the disclosure illustrating the organizer in position on a phone.
Figure 5:
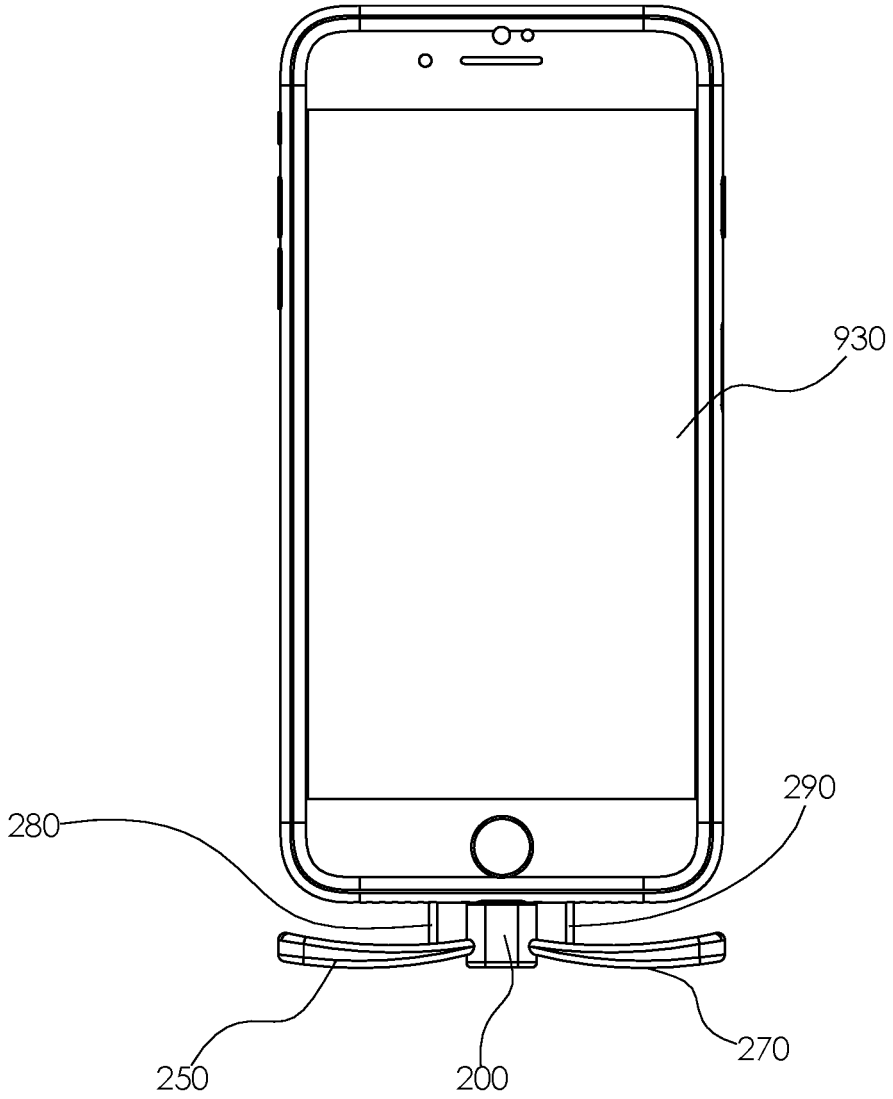
FIG. 5 is a top view of an embodiment of the disclosure illustrating the organizer in position on a phone.
Figure 6:
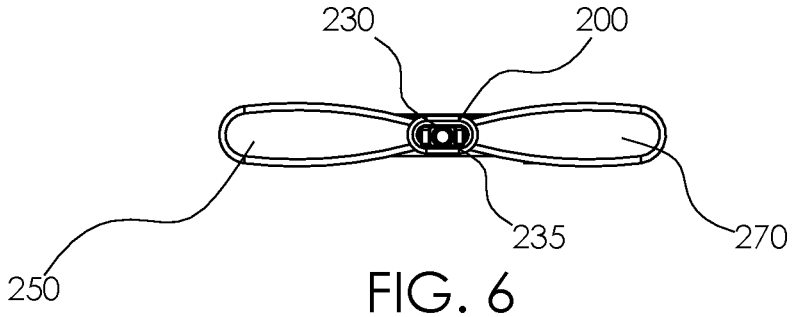
FIG. 6 is a front view of an embodiment of the disclosure illustrating the organizer in position on a phone.
Figure 7:
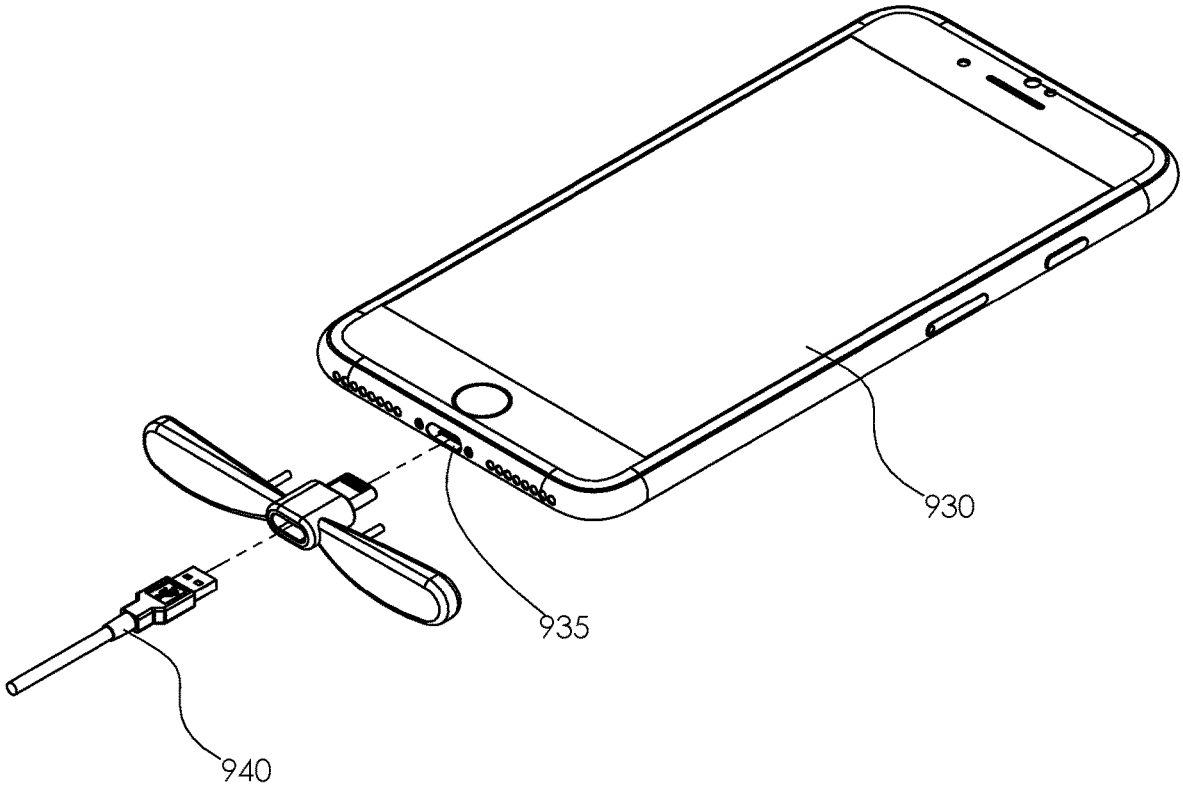
FIG. 7 is an exploded perspective view of an embodiment of the disclosure.
Figure 8:
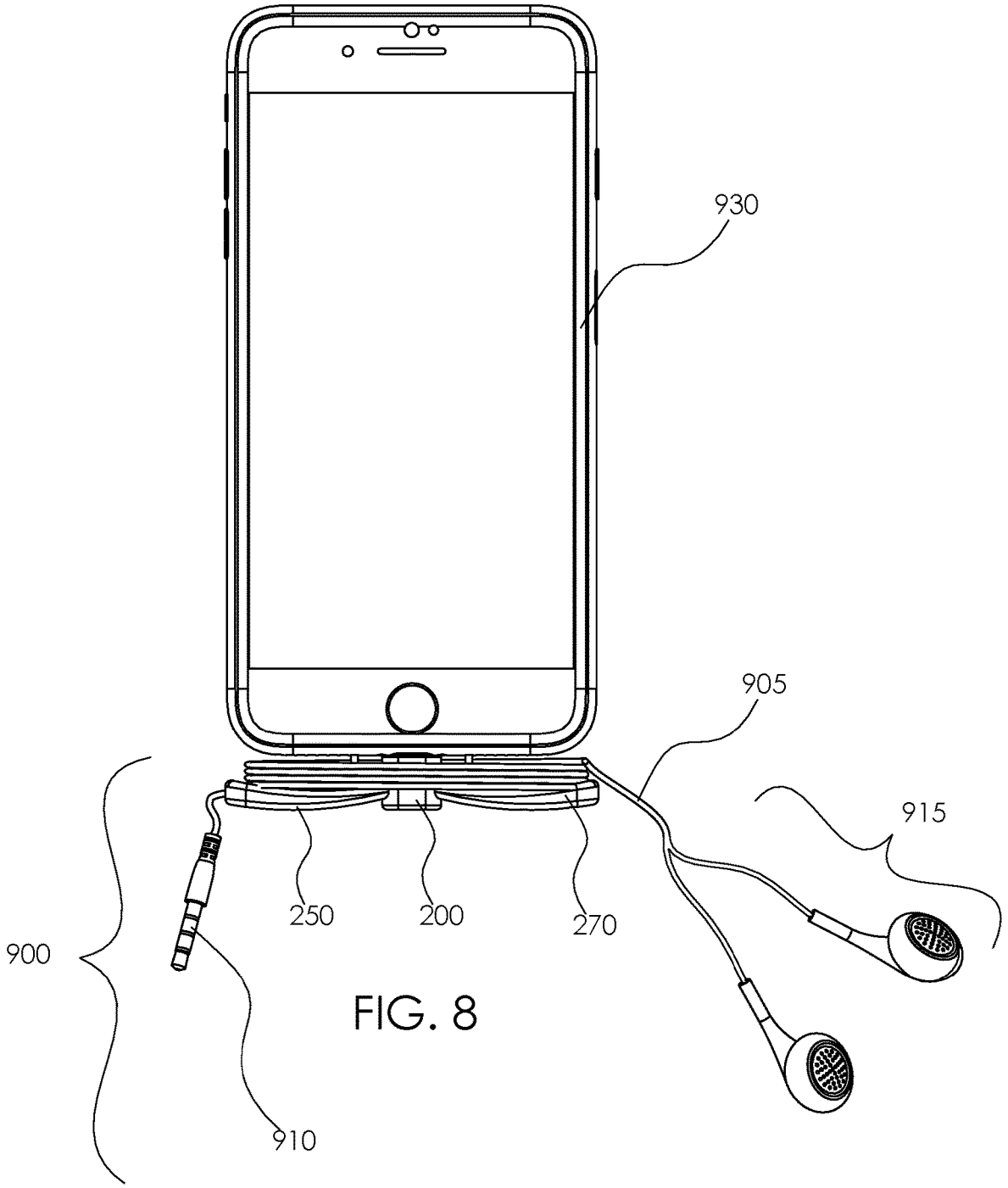
FIG. 8 is a top view of an embodiment of the disclosure while in use with the earphone cord "oval wrapped" on the organizer.
Figure 9:
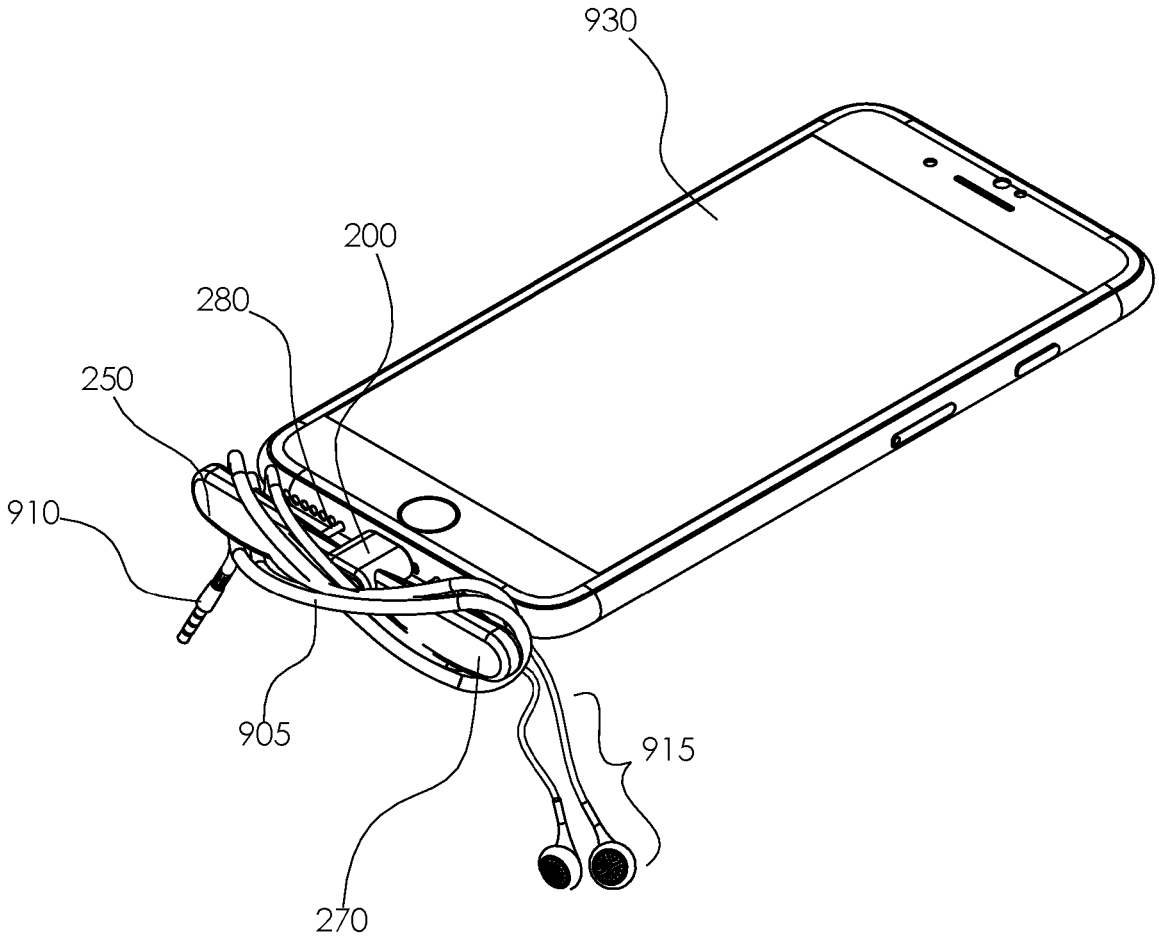
FIG. 9 is a perspective view of an embodiment of the disclosure while in use with the earphone cord "figure-8 wrapped" on the organizer.
Figure 10:
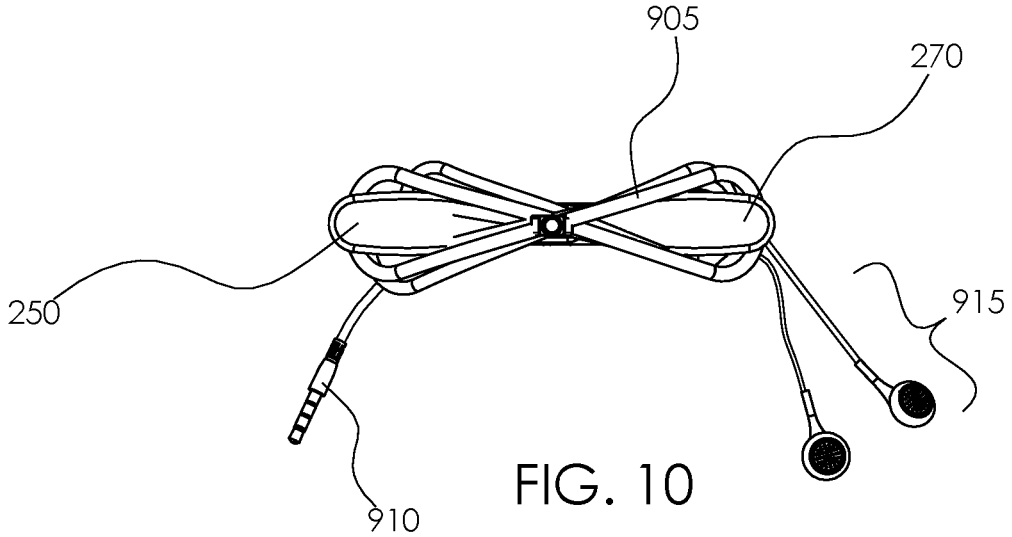
FIG. 10 is a front view of an embodiment of the disclosure while in use with the earphone cord "figure-8 wrapped" on the organizer.

Detailed reference will now be made to a first potential embodiment of the disclosure, which is illustrated in FIGS. 1 through 10.

The earphone cord organizer 100 (hereinafter invention) comprises a coupler body 200, a first arm 250, a second arm 270, and a male electrical connector 210. The invention 100 removably couples to a smart phone 930 and provides a retainer for a set of earphones 900. As used herein, the term "earphones" includes earphones, ear buds, in-ear headphones, and personal headphones.

The coupler body 200 may be an armature that removably couples to the smart phone 930. The male electrical connector 210 may protrude from the rear of the coupler body 200. The coupler body 200 may couple to the smart phone 930 by inserting the male electrical connector 210 into an existing phone connector 935.

The first arm 250 and the second arm 270 may be coupled to the coupler body 200 and may extend from the coupler body 200 in opposite directions. The directions that the first arm 250 and the second arm 270 extend from the coupler body 200 may be perpendicular to the direction that the male electrical connector 210 extends from the coupler body 200. The coupler body 200, the first arm 250, and the second arm 270 may be configured to store the set of earphones 900. As a non-limiting example, with the male electrical connector 210 inserted into the existing phone connector 935, the set of earphones 900 may be stored on the invention 100 by placing an earpieces 915 adjacent to the coupler body 200 wrapping an earphone cord 905 around the coupler body 200 being certain to pass the earphone cord 905 between the first arm 250 and the smart phone 930 and between the second arm 270 and the smart phone 930 on each wrap, and tucking an earphone plug 910 into the wraps of the earphone cord 905. In some embodiments, the longitudinal length of the first arm 250 may be the same as the longitudinal length of the second arm 270.

The invention 100 may further comprise a first wrap extender 280 and a second wrap extender 290. The first wrap extender 280 and the second wrap extender 290 may increase the width of the coupler body 200 that the earphone cord 905.

The first wrap extender 280 may be an armature that extends away from the rear surface of the first arm 250, perpendicular to the first arm 250. The distance that the first wrap extender 280 extends may match the distance between the rear surface of the first arm 250 and the smart phone 930 such that when the invention 100 is in place on the smart phone 930 the first wrap extender 280 touches the outer shell of the smart phone 930.

The second wrap extender 290 may be an armature that extends away from the rear surface of the second arm 270, perpendicular to the second arm 270. The distance that the second wrap extender 290 extends may match the distance between the rear surface of the second arm 270 and the smart phone 930 such that when the invention 100 is in place on the smart phone 930 the second wrap extender 290 touches the outer shell of the smart phone 930.

The coupler body 200 may further comprise a female electrical connector 230. The male electrical connector 210 and the female electrical connector 230 may be complementary connectors for the same type of interface. As non-limiting example, the male electrical connector 210 and the female electrical connector 230 may be male and female connectors implementing a USB-mini, Lightning®, USB-mini, or other smartphone connector. In some embodiments, the female electrical connector 230 may be located on the side of the coupler body 200 that is opposite the male electrical connector 210. In some embodiments, the female electrical connector 230 may be located on one of the sides that is both perpendicular to the male electrical connector 210 and perpendicular to the first arm 250 and the second arm 270.

The male electrical connector 210 may comprise a first plurality of electrical contacts 215. The female electrical connector 230 may comprise a second plurality of electrical contacts 235. The number of contacts in the first plurality of electrical contacts 215 on the male electrical connector 210 is the same as the number of contacts in the second plurality of electrical contacts 235 on the female electrical connector 230. Specifically, each first individual contact selected from the first plurality of electrical contacts 215 corresponds to exactly one second individual contact selected from the second plurality of electrical contacts 235. Each of the first individual contacts selected from the first plurality of electrical contacts 215 may be electrically connected to the corresponding one of the second individual contact selected from the second plurality of electrical contacts 235. When the male electrical connector 210 is inserted into the existing phone connector 935, the invention 100 may extend the interface to the female electrical connector 230 such that an external cable 940 may plug into the female electrical connector 230 and function as if it were plugged into the existing phone connector 935.

In some embodiments, the distance between the distal ends of the first arm 250 and the second arm 270 may be the same as the width of the smart phone 930.

In use, the invention 100 may be plugged into the bottom of the smart phone 930 by pressing the male electrical connector 210 into the existing phone connector 935. The external cable may be used, if needed, by plugging the external cable 940 into the female electrical connector 230 on the coupler body 200. When the set of earphones 900 are not being used, they may be stored on the invention 100 by wrapping the earphone cord 905 around the invention 100 and tucking the earphone plug 910 into wraps of the earphone cord 905 that are already on the invention 100. It may be noted that the earphone cord 905 may be wrapped in a simple oval pattern by feeding the earphone cord 905 onto the invention 100 in a circular motion without reversing direction or in a "figure-8" pattern by crossing over the coupler body 200 to reverse direction on each arm.

DEFINITIONS

As used in this disclosure, a "cable" is a collection of insulated wires covered by a protective casing that is used for transmitting electricity or telecommunication signals.

As used herein, the words "couple", "couples", "coupled" or "coupling", refer to connecting, either directly or indirectly, and does not necessarily imply a mechanical connection.

As used in this disclosure, the terms "distal" and "proximal" may be used to describe relative positions. Distal refers to the object, or the end of an object, that is situated away from the point of origin, point of reference, or point of attachment. Proximal refers to the object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point or a central axis of an object and the direction of comparison may be in a radial or lateral direction.

As used in this disclosure, an "earphone" refers to a device that converts electrical signals into audible sounds that are worn or listened to in contact with the ear.

As used herein, "front" indicates the side of an object that is closest to a forward direction of travel under normal use of the object or the side or part of an object that normally presents itself to view or that is normally used first. "Rear" or "back' refers to the side that is opposite the front.

As used herein, the word "longitudinal" or "longitudinally" refers to a lengthwise or longest direction.

As used in this disclosure, "one of the sides" refers directly to a side selected from the third side, the fourth side, the fifth side, or the sixth side.

As used in this disclosure, an "oval" is a geometric shape that is formed in the shape of a flattened circle, similar in form to an ellipse. The shape may also sometimes be described as egg shaped. The difference between an oval and an ellipse is that an ellipse can be described by a mathematical formula while an oval has no such description.

As used in this disclosure, a "plug" is an electrical termination that electrically connects a first electrical circuit to a second electrical circuit or a source of electricity.

As used in this disclosure, a "shell" is a structure that forms an outer covering intended to contain an object. Shells are often, but not necessarily always, rigid or semi-rigid structures that are intended to protect the object contained within it. Some shells may only partially cover the exterior surface of the object.

As used in this disclosure, a "socket" is an opening or cavity that is configured to receive an inserted component.

As used in this disclosure, "USB" is an acronym for Universal Serial Bus, which is an industry standard that defines the cables, the connectors, the communication protocols and the distribution of power required for interconnections between electronic devices. The USB standard defines several connectors including, but not limited to, USB-A, USB-B, mini-USB, and micro USB connectors.

With respect to the above description, it is to be realized that the optimum dimensional relationship for the various components of the invention described above and in FIGS. 1 through 10, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A earphone cord organizer comprising:

a coupler body, a first arm, a second arm, and a male electrical connector;

wherein the earphone cord organizer removably couples to a smart phone and provides a retainer for a set of earphones;

wherein the coupler body comprises a female electrical connector;

wherein the male electrical connector and the female electrical connector are complementary connectors for the same type of interface;

wherein the male electrical connector comprises a first plurality of electrical contacts;

wherein the female electrical connector comprises a second plurality of electrical contacts;

wherein the number of contacts in the first plurality of electrical contacts on the male electrical connector is the same as the number of contacts in the second plurality of electrical contacts on the female electrical connector;

wherein each first individual contact selected from the first plurality of electrical contacts corresponds to exactly one second individual contact selected from the second plurality of electrical contacts.

2. The earphone cord organizer according to claim 1 wherein the coupler body is an armature that removably couples to the smart phone.

3. The earphone cord organizer according to claim 2 wherein the male electrical connector protrudes from the rear of the coupler body.

4. The earphone cord organizer according to claim 3 wherein the coupler body couples to the smart phone by inserting the male electrical connector into an existing phone connector.

5. The earphone cord organizer according to claim 4 wherein the first arm and the second arm are coupled to the coupler body and extend from the coupler body in opposite directions.

6. The earphone cord organizer according to claim 5 wherein the directions that the first arm and the second arm extend from the coupler body are perpendicular to the direction that the male electrical connector extends from the coupler body.

7. The earphone cord organizer according to claim 6 wherein the longitudinal length of the first arm is the same as the longitudinal length of the second arm.

8. The earphone cord organizer according to claim 7 wherein the earphone cord organizer comprises a first wrap extender and a second wrap extender;

wherein the first wrap extender and the second wrap extender increase the width of the coupler body that an earphone cord.

9. The earphone cord organizer according to claim 8 wherein the first wrap extender is an armature that extends away from the rear surface of the first arm, perpendicular to the first arm.

10. The earphone cord organizer according to claim 9 wherein the distance that the first wrap extender extends matches the distance between the rear surface of the first arm and the smart phone such that when the earphone cord organizer is in place on the smart phone the first wrap extender touches the outer shell of the smart phone.

11. The earphone cord organizer according to claim 10 wherein the second wrap extender is an armature that extends away from the rear surface of the second arm, perpendicular to the second arm.

12. The earphone cord organizer according to claim 11 wherein the distance that the second wrap extender extends matches the distance between the rear surface of the second arm and the smart phone such that when the earphone cord organizer is in place on the smart phone the second wrap extender touches the outer shell of the smart phone.

13. The earphone cord organizer according to claim 12 wherein the female electrical connector is located on the side of the coupler body that is opposite the male electrical connector.

14. The earphone cord organizer according to claim 12 wherein the female electrical connector is located on one of the sides that is both perpendicular to the male electrical connector and perpendicular to the first arm and the second arm.

15. The earphone cord organizer according to claim 14 wherein each of the first individual contacts selected from the first plurality of electrical contacts is electrically connected to the corresponding one of the second individual contact selected from the second plurality of electrical contacts.

16. The earphone cord organizer according to claim 15 wherein when the male electrical connector is inserted into the existing phone connector, the earphone cord organizer extends the interface to the female electrical connector such that an external cable plugs into the female electrical connector and functions as if it were plugged into the existing phone connector.

17. The earphone cord organizer according to claim 16 wherein the distance between the distal ends of the first arm and the second arm is the same as the width of the smart phone.

* * * * *